US009977443B2

(12) United States Patent
Guo et al.

(10) Patent No.: US 9,977,443 B2
(45) Date of Patent: May 22, 2018

(54) LOW DROPOUT LINEAR REGULATORS AND STARTING METHODS THEREFOR

(71) Applicant: Media Tek Singapore Pte. Ltd., Singapore (SG)

(72) Inventors: Jun-Yan Guo, Singapore (SG); Hong-Sing Kao, Singapore (SG)

(73) Assignee: MEDIATEK SINGAPORE PTE. LTD., Singapore (SG)

( * ) Notice: Subject to any disclaimer, the term of this patent is extended or adjusted under 35 U.S.C. 154(b) by 0 days. days.

(21) Appl. No.: 15/685,179

(22) Filed: Aug. 24, 2017

(65) Prior Publication Data

US 2017/0351283 A1 Dec. 7, 2017

Related U.S. Application Data

(63) Continuation of application No. 14/471,123, filed on Aug. 28, 2014.

(30) Foreign Application Priority Data

Aug. 28, 2013 (CN) ..... 2013 1 0380435

(51) Int. Cl.
*G05F 1/10* (2006.01)
*G05F 3/02* (2006.01)
(Continued)

(52) U.S. Cl.
CPC ..... *G05F 1/56* (2013.01); *G05F 1/575* (2013.01)

(58) Field of Classification Search
CPC ..... G05F 1/465; G05F 3/262; G05F 3/247; G05F 3/24; G11C 5/147
(Continued)

(56) References Cited

U.S. PATENT DOCUMENTS 5,629,609 A 5/1997 Nguyen
6,529,563 B1 3/2003 Mosinskis et al.
(Continued)

FOREIGN PATENT DOCUMENTS

CN 101813958 A 8/2010
CN 102650893 A 8/2012
(Continued)

*Primary Examiner* — Quan Tra
(74) *Attorney, Agent, or Firm* — McClure, Qualey & Rodack, LLP

(57) ABSTRACT

A low dropout linear regulator, a starting method, an electronic device, and a chip are provided. Wherein the low dropout linear regulator comprises an error amplifier circuit, an over current circuit and an over-current adjustor, the starting method includes: beginning a soft-starting process of the low dropout linear regulator and turning on a first transistor and a second transistor to provide a over current to raise an output voltage of the low dropout linear regulator; maintaining the 'turn on' state of the first transistor and the second transistor and decreasing the over current according to a signal obtained from the error amplifier circuit after the output voltage of the low dropout linear regulator reaches a starting voltage of the error amplifier circuit; wherein the error amplifier circuit begins to operate when the output voltage of the low dropout linear regulator reaches the starting voltage of the error amplifier circuit.

14 Claims, 11 Drawing Sheets

(51) Int. Cl.
*G05F 1/56* (2006.01)
*G05F 1/575* (2006.01)

(58) Field of Classification Search
USPC ..... 327/538, 540, 541, 543
See application file for complete search history.

(56) References Cited

U.S. PATENT DOCUMENTS

| | | | | |
|---|---|---|---|---|
| 7,974,060 | B2 * | 7/2011 | Morino | G05F 1/573 361/93.9 |
| 8,169,202 | B2 | 5/2012 | Chen | |
| 8,564,263 | B2 * | 10/2013 | Chen | G05F 1/573 323/226 |
| 8,575,906 | B2 | 11/2013 | Morino | |
| 9,323,258 | B2 | 4/2016 | Nakashimo | |
| 2009/0295340 | A1 | 12/2009 | Kwon et al. | |
| 2010/0117608 | A1 | 5/2010 | Tseng | |
| 2010/0213908 | A1 | 8/2010 | Chen | |
| 2011/0096572 | A1 | 4/2011 | Liang et al. | |
| 2011/0181259 | A1 | 7/2011 | Shen | |
| 2012/0074921 | A1 | 3/2012 | Kim | |
| 2013/0113454 | A1 | 5/2013 | Chen et al. | |
| 2015/0177752 | A1 | 6/2015 | Nakashimo | |

FOREIGN PATENT DOCUMENTS

| | | | |
|---|---|---|---|
| CN | 103178701 | A | 6/2013 |
| JP | 2005301439 | A | 10/2005 |

* cited by examiner

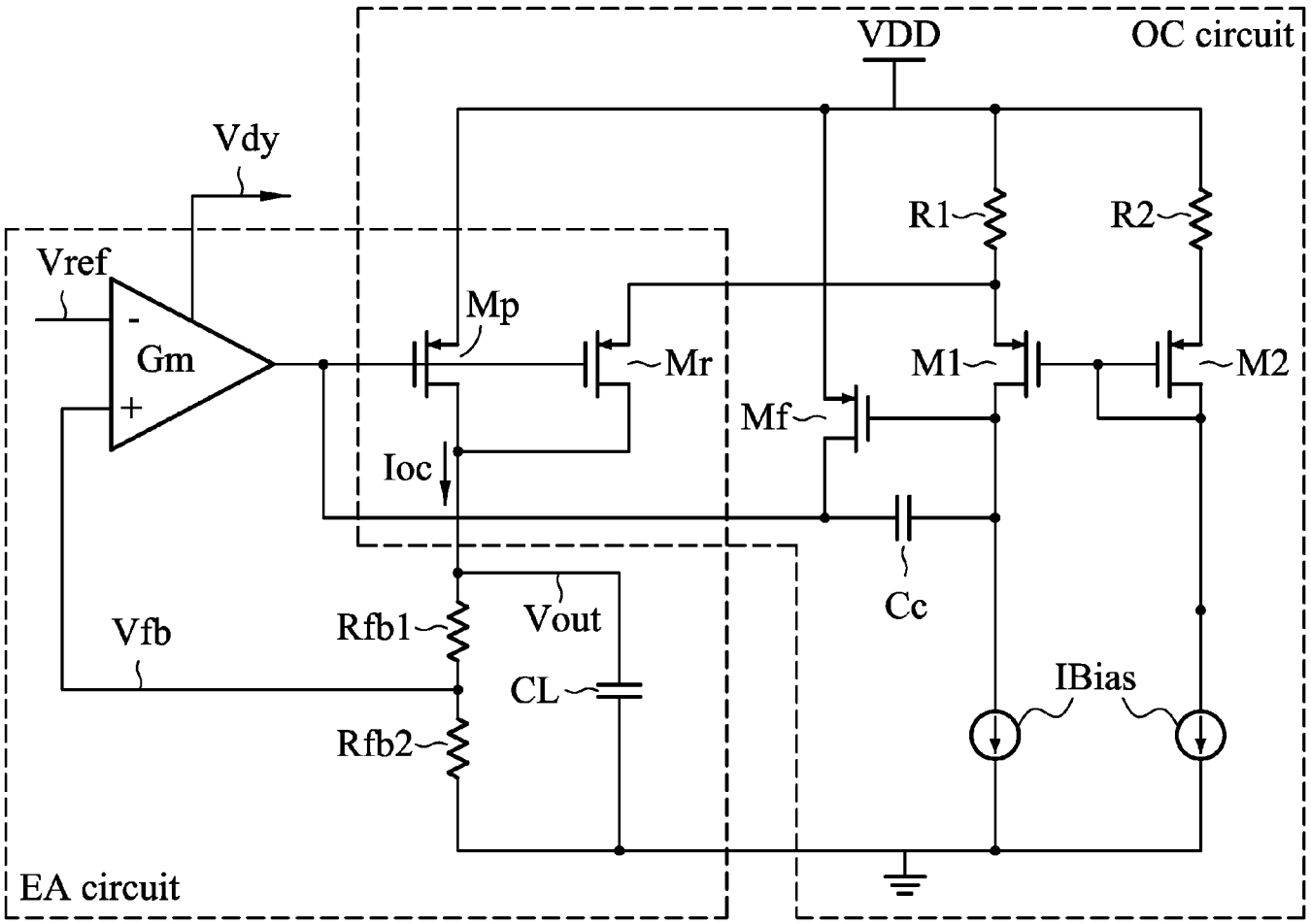
FIG. 1 ( PROIOR ART )

( PROIOR ART )

( PROIOR ART )

( PROIOR ART )

( PROIOR ART )

LOW DROPOUT LINEAR REGULATORS AND STARTING METHODS THEREFOR

CROSS REFERENCE TO RELATED APPLICATIONS

This application is a Continuation of U.S. application Ser. No. 14/471,123 filed on Aug. 28, 2014, which claims priority of China Patent Application No. 201310380435.9, filed on Aug. 28, 2013, the entirety of which is incorporated by reference herein.

BACKGROUND OF THE INVENTION

Field of the Invention

The invention relates to a power source circuit, and more particularly to a low dropout linear regulator, a starting method, an electronic device, and a chip thereof.

Description of the Related Art

With development of power source techniques, power sources gradually have become miniaturized and digitized. Thus, power source chips can be used in various applications. In current power source chips, a low dropout linear regulator (LDO) is one of the regulated supply circuits which are applied widely. The operation of the LDO is to compare an output feedback voltage Vfb and a reference voltage Vref by an error amplifier (EA) and control the difference between the output feedback voltage Vfb and the reference voltage Vref for finally obtaining a regulated output voltage Vout. In order to obtain a regulated output voltage Vout, an over current (OC) circuit for soft-starting has be configured in the entire circuit of the LDO to ensure that the entire circuit enters a direct current bias state after the power of the LDO is turned on. In an LDO used in a fast startup device, two main factors for the design of the soft-starting are: ensuring the degree of the overshoot of the output voltage being the minimum value and the starting period being shorter as much as possible.

FIG. 1 shows a circuit of a conventional low dropout linear regulator (LDO). The circuit of the LDO comprises an error amplifier (EA) circuit and an over current (OC) circuit. After the circuit of the LDO is turned on, the circuit enters a soft-starting process, and the OC circuit begins to operate. At this time, the EA circuit is in a locked state. When an output voltage Vout approaches a predetermined target voltage, the EA circuit reaches its start voltage and then begins to operate. When the output voltage Vout reaches the predetermined target voltage and tends towards a stable state, in the circuit of the LDO, only the EA circuit operates. At this time, the soft-start process ends, and the circuit of the LDO starts normally.

FIGS. 2A and 2B show linear variation over time of a threshold of an over current and an output voltage during one typical soft-starting process when the circuit of the LDO in FIG. 1 is applied. During the soft-starting process, the OC circuit provides a larger over current. At this time, the starting time of the circuit of the LDO is shorter. However, after the output voltage Vout reaches a target output voltage value, the output voltage Vout also still rises to generate a greater overshoot voltage, which may cause damages to the circuit of the LDO.

FIGS. 3A and 3B show linear variation over time of a threshold of an over-current and an output voltage during another typical soft-starting process when the circuit of the LDO in FIG. 1 is applied. During the soft-starting process, the OC circuit provides a small over-current, and the output voltage Vout increases gradually. After the EA circuit starts, the output voltage Vout tends to stabilize. At this time, the output voltage Vout generates a smaller overshoot voltage. However, the required starting time is longer than that under the situation in FIGS. 2A and 2B.

According to the above two typical soft-starting processes, when the starting time is shorter, there is inevitably a greater overshoot voltage. The greater over voltage may break the circuit elements and shorten the life of the circuit elements. To make the soft-starting overshoot voltage smaller, a smaller OC current must be used, which lengthens the charging time. Even though the overshoot voltage becomes smaller, the problem of the excessively long soft-starting time is induced, which slows down the response speed and degrades the working efficiency.

BRIEF SUMMARY OF THE INVENTION

Thus, it is desirable to provide a regulator with a soft-starting operation. The soft-starting operation can adapt to the requirements of high working efficiency, effective circuit protection, and enhancement of usage quality and lifespan of the regulator.

The embodiments of the present invention provide a low dropout linear regulator which comprises an error amplifier circuit, an over current circuit and an over-current adjustor, a starting method of the low dropout linear regulator, an electronic device, and a chip. In the prior art, during the soft-starting process, the overshoot voltage is large due to a large over current, and the large overshoot voltage may result in circuit elements being broken to shorten the usage life. Moreover, in prior arts, when the over current is less during the soft-starting process, charging time and starting time become longer. The above problems in prior arts are solved by the embodiments of the present invention.

An exemplary embodiment of a starting method for a low dropout linear regulator is provided. The starting method comprises: beginning a soft-starting process of the low dropout linear regulator and turning on a first transistor and a second transistor to provide a over current to raise an output voltage of the low dropout linear regulator; maintaining the 'turn on' state of the first transistor and the second transistor and decreasing the over current according to a signal obtained from the error amplifier circuit after the output voltage of the low dropout linear regulator reaches a starting voltage of the error amplifier circuit; wherein the error amplifier circuit begins to operate when the output voltage of the low dropout linear regulator reaches the starting voltage of the error amplifier circuit.

According to the exemplary embodiment of the starting method of the low dropout linear regulator, in one aspect, the signal obtained from the error amplifier is a signal whose variation direction is the same as a variation direction of the output voltage or whose variation direction is opposite to the variation direction of the output voltage.

According to the exemplary embodiment of the starting method of the low dropout linear regulator, in another aspect, the signal obtained from the error amplifier is the output voltage of the error amplifier circuit.

According to the exemplary embodiment of the starting method of the low dropout linear regulator, in further another aspect, the step of the step of decreasing the over current according to a signal obtained from the error amplifier circuit is performed when the over current circuit and the error amplifier circuit operate at the same time.

According to the exemplary embodiment of the starting method of the low dropout linear regulator, in also another aspect, the step of decreasing the over current according to a signal obtained from the error amplifier circuit is performed when the output voltage reaches a target output voltage.

According to the exemplary embodiment of the starting method of the low dropout linear regulator, in one aspect, the step of decreasing the over current according to a signal obtained from the error amplifier circuit comprises: decreasing the over current from a first current threshold to a second current threshold along a curve according to a signal obtained from the error amplifier circuit; or decreasing the over current directly from the first current threshold to the second current threshold according to a signal obtained from the error amplifier circuit.

An exemplary embodiment of a low dropout linear regulator is provided. The low dropout linear regulator comprises: an over current circuit, turning on a first transistor and a second transistor to provide a over current to raise an output voltage of the low dropout linear regulator when a soft-starting process of the low dropout linear regulator begins; an error amplifier circuit, beginning to operate when an output voltage of the low dropout linear regulator reaches a starting voltage of the error amplifier circuit; and an over-current adjustor, maintaining the 'turn on' state of the first transistor and the second transistor and decreasing the over current according to a signal obtained from the error amplifier circuit after the output voltage of the low dropout linear regulator reaches a starting voltage of the error amplifier circuit.

According to the exemplary embodiment of the low dropout linear regulator, in one aspect, over-current adjustor decreases the over current according to a signal, whose variation direction is the same as a variation direction of the output voltage, obtained from the error amplifier circuit; or the over-current adjustor decreases the over current according to a signal, whose variation direction is opposite to the variation direction of the output voltage, obtained from the error amplifier circuit.

According to the exemplary embodiment of the low dropout linear regulator, in another aspect, the over-current adjustor decreases the over current according to the output voltage obtained from the error amplifier circuit.

According to the exemplary embodiment of the low dropout linear regulator, in further another aspect, the over-current adjustor decreases the over current according to the signal obtained from the error amplifier circuit when the over current circuit and the error amplifier circuit operate at the same time.

According to the exemplary embodiment of the low dropout linear regulator, in one aspect, the low dropout linear regulator further comprises: a voltage detector, coupled to the over-current adjustor, generating a detection signal when the output voltage approaches a target output voltage, wherein the over-current adjustor decreases the over current according to a signal obtained from the error amplifier circuit when the detection signal indicates that the output voltage reaches the target output voltage.

According to the exemplary embodiment of the low dropout linear regulator, in another aspect, according to a signal obtained from the error amplifier circuit, the over-current adjustor decreases the over current from a first current threshold to a second current threshold along a curve; or according to a signal obtained from the error amplifier circuit, the over-current adjustor decreases the over current directly from the first current threshold to the second current threshold.

An exemplary embodiment of an electronic device is provided. The electronic device comprises any one low dropout linear regulator described above.

An exemplary embodiment of a chip is provided. The chip comprises any one low dropout linear regulator described above.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 1 shows a circuit of a conventional low dropout linear regulator (LDO);

DETAILED DESCRIPTION OF THE INVENTION

Figure 2A:
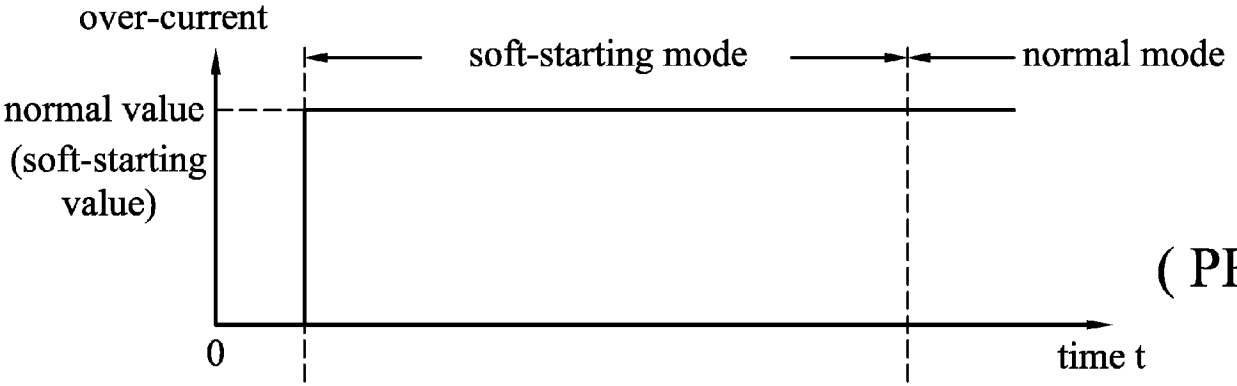
FIG. 2A shows linear variation over time of a threshold of an over current during one typical soft-starting process of a low dropout linear regulator.
Figure 2B:
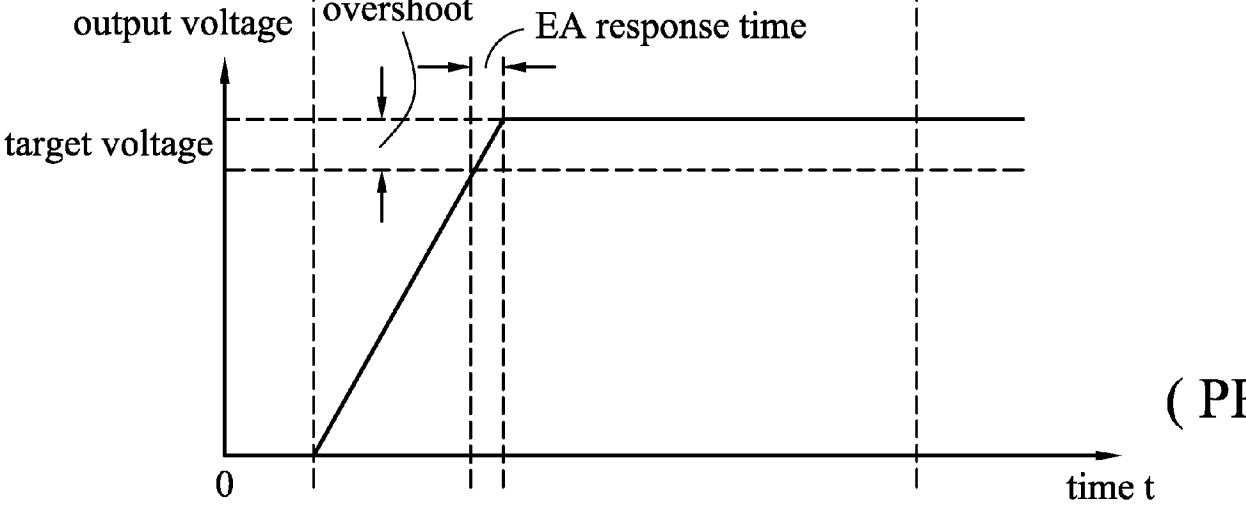
FIG. 2B shows linear variation over time of an output voltage during one typical soft-starting process of a low dropout linear regulator.
Figures 3A, 3B:
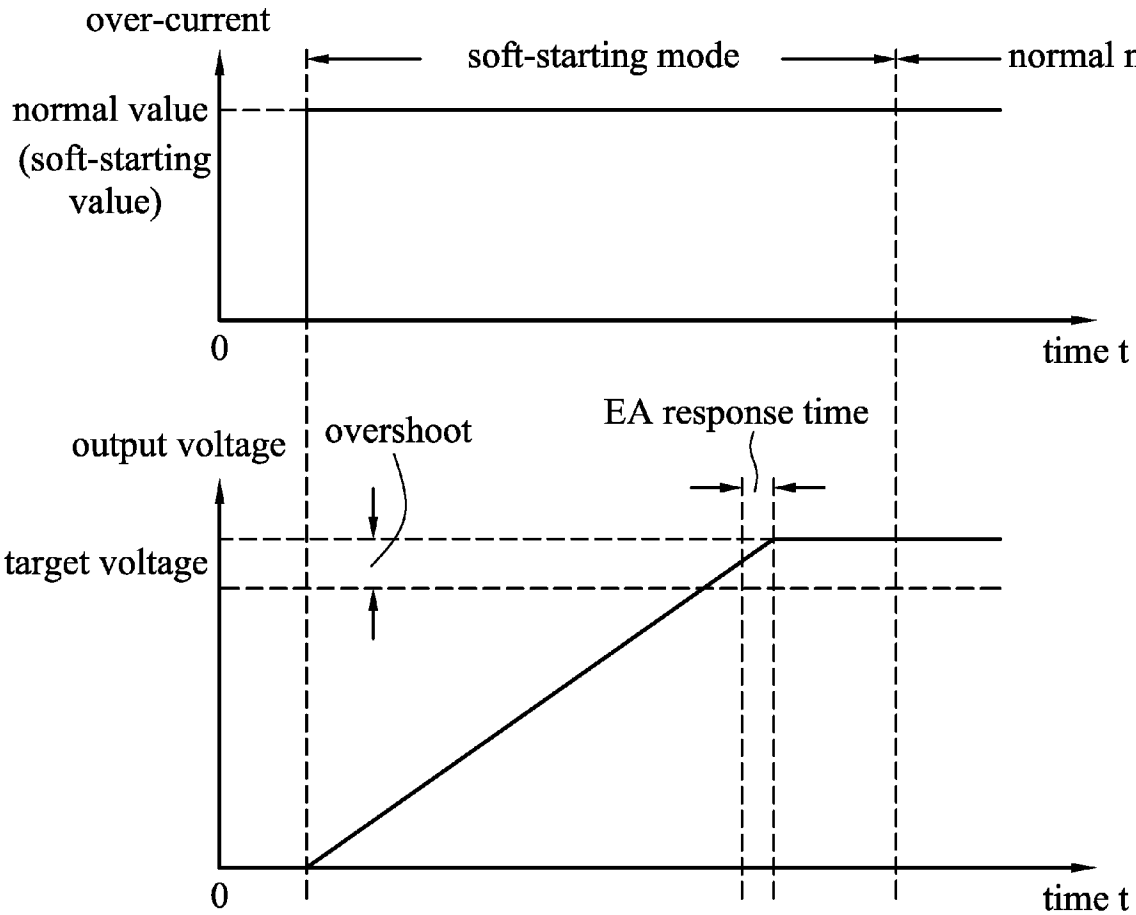
FIG. 3A shows linear variation over time of a threshold of an over current during another typical soft-starting process of a low dropout linear regulator.
FIG. 3B shows linear variation over time of an output voltage during another typical soft-starting process of a low dropout linear regulator.

Exemplary embodiments of the present invention will now be described more fully with reference to the accompanying drawings, in which exemplary embodiments of the invention are shown. Various advantages and features of the present invention and methods of accomplishing the same maybe understand more readily by reference to the following detailed description of exemplary embodiments and the accompanying drawings. The present invention may, however, be embodied in many different forms and should not be constructed as being limited to the exemplary embodiments set forth herein. Rather, these exemplary embodiments are provided so that this disclosure will be thorough and complete and will fully convey the concept of the invention to those skilled in the art, and the present invention will only be defined by the appended claims. Like reference numerals refer to like elements throughout the specification.

Figure 4:
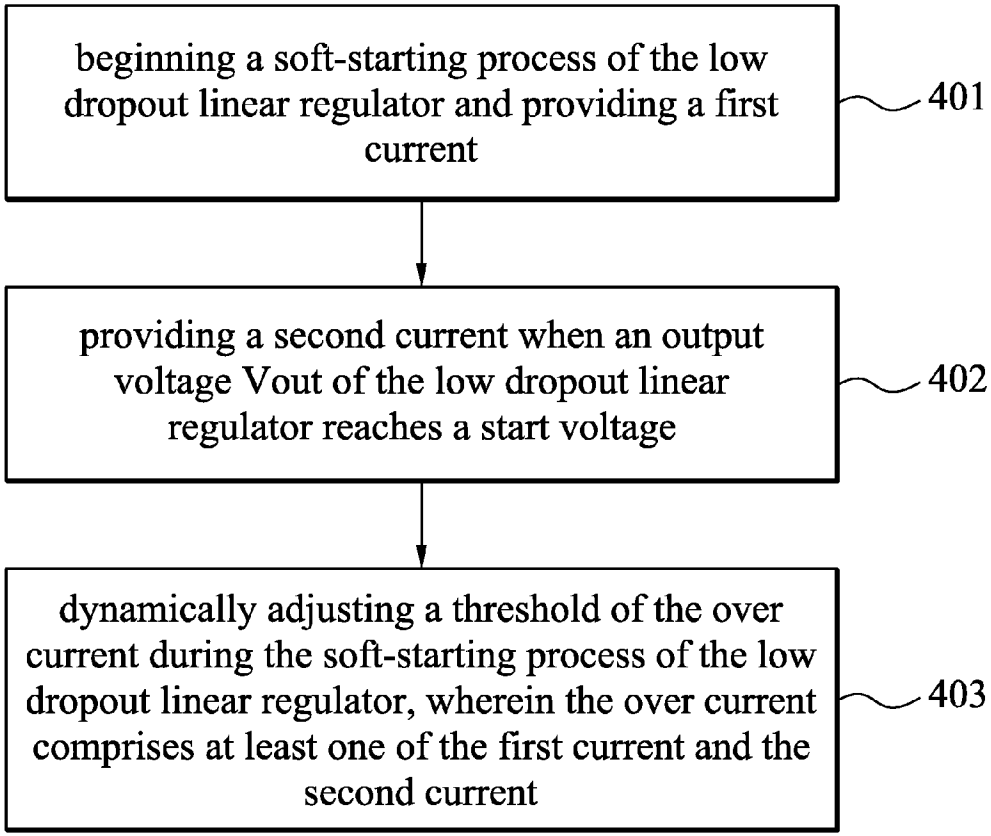
FIG. 4 is a flow chart of an exemplary embodiment of a starting method of a low dropout linear regulator according to the invention.

FIG. 4 is a flow chart of an exemplary embodiment of a starting method of a low dropout linear regulator. The starting method comprises:

Step 401: beginning a soft-starting process of the low dropout linear regulator and providing a first current;

Step 402: providing a second current when an output voltage Vout of the low dropout linear regulator reaches a start voltage; and Step 403: dynamically adjusting a threshold of the over current during the soft-starting process of the low dropout linear regulator, wherein the over current comprises at least one of the first current and the second current.

Specifically, at the beginning when the low dropout linear regulator starts, a bypass capacitor is not charged, and the voltage of the bypass capacitor is equal to zero. When the low dropout linear regulator enters the soft-starting process, an over current (OC) circuit begins to operate and provides the first current. An error amplifier (EA) circuit is in a locked state. When the output voltage Vout reaches the starting voltage which is applied to release the locked state, the error amplifier circuit begins to operate and provides the second current. At first, the over current circuit decides to provide the current to the bypass capacitor, such that the output voltage Vout of the low dropout linear regulator rises rapidly. During the process, dynamically adjusting the threshold of the over current may lessen the overshoot between the output voltage Vout and a target output voltage. When the output voltage Vout becomes stable, the soft-starting process ends. Dynamically adjusting the threshold of the over current can be achieved in the following manner: dynamically adjusting the threshold of the over current by an auxiliary circuit of the low dropout linear regulator according to the relationship between the target output voltage at the stable state of the low dropout linear regulator and the threshold of the over current. Accordingly, the circuit of the low dropout linear regulator can enter the stable state in a short time, and it is sure that the overshoot between the output voltage Vout and the target output voltage is less. It can be understood that the over current comprises least one of the first current and the second current.

In one embodiment, the auxiliary circuit comprises a voltage output device. A voltage signal output by the voltage output device and the output voltage Vout of the low dropout linear regulator vary in the same direction or in two directions which are opposite to each other. In other words, the variation direction of the voltage signal is the same as or opposite to that of the output voltage Vout. However, the variation amplitude of the voltage signal can be different from that of the output voltage Vout. By using the voltage signal with the variation by the same direction or the two opposite directions, the objective of dynamically adjusting the threshold of the over current can be achieved.

In one embodiment, the voltage signal which is in proportion to the output voltage Vout is obtained from the error amplifier (EA) circuit, such that the threshold of the over current is dynamically adjusted according to a signal obtained from the error amplifier (EA) circuit.

In another embodiment, the threshold of the over current is dynamically adjusted directly according to the output voltage Vout obtained from the error amplifier circuit.

In further another embodiment, a signal whose variation direction is the same as or opposite to the variation direction of the output voltage Vout is obtained from any position on the inside of the low dropout linear regulator. Furthermore, an adjustment device is disposed on the inside of the low dropout linear regulator. For example, the variation direction of the obtained voltage is opposite to that of the output voltage Vout, and the adjustment device is implemented by an inverter. Via the inverter, the obtained signal becomes a signal whose variation direction is the same as the variation direction of the output voltage Vout. The adjustment device and the obtained signal cooperate to dynamically adjust the threshold of the over current. There are many different embodiments for dynamically adjusting the threshold of the over current, however, the related description is omitted here.

In one embodiment, dynamically adjusting the threshold of the over current comprises: adjusting the threshold when the over current (OC) circuit and the error amplifier (EA) circuit operate simultaneously. In this case, the threshold of the over current is decreased through the manners of the above embodiment, such that the overshot between the output voltage Vout and the target output voltage becomes less to shorten the soft-starting time of the low dropout linear regulator.

In another embodiment, dynamically adjusting the threshold of the over current further comprises: decreasing the threshold of the over current when the output voltage Vout approaches the target output voltage. Specifically, at the beginning of the soft-starting process of the low dropout linear regulator, the output voltage Vout rises rapidly in response to the starting of the low dropout linear regulator. When the output voltage Vout approaches the target output voltage but has not yet reached the target output voltage, the threshold of the over current is decreased, which can ensure that the overshot between the output voltage Vout and the target output voltage is less and the soft-starting time of the low dropout linear regulator is short.

In an embodiment, decreasing the threshold of the over current comprises: decreasing the threshold of the over current from a first current threshold to a second current threshold along a curve; or decreasing the threshold of the over current from the first current threshold directly to the second current threshold. No matter what manner described above is taken to decrease the threshold of the over current, the overshot between the output voltage Vout and the target output voltage can become less, and the soft-starting time of the low dropout linear regulator can be shortened.

Through the soft-starting method of the low dropout linear regulator in the embodiments, when the circuit starts, a fast starting process in which the amount of the overshoot of the output voltage Vout is less is provided, thereby protecting the circuit and enhancing usage quality and life.

Figure 5:
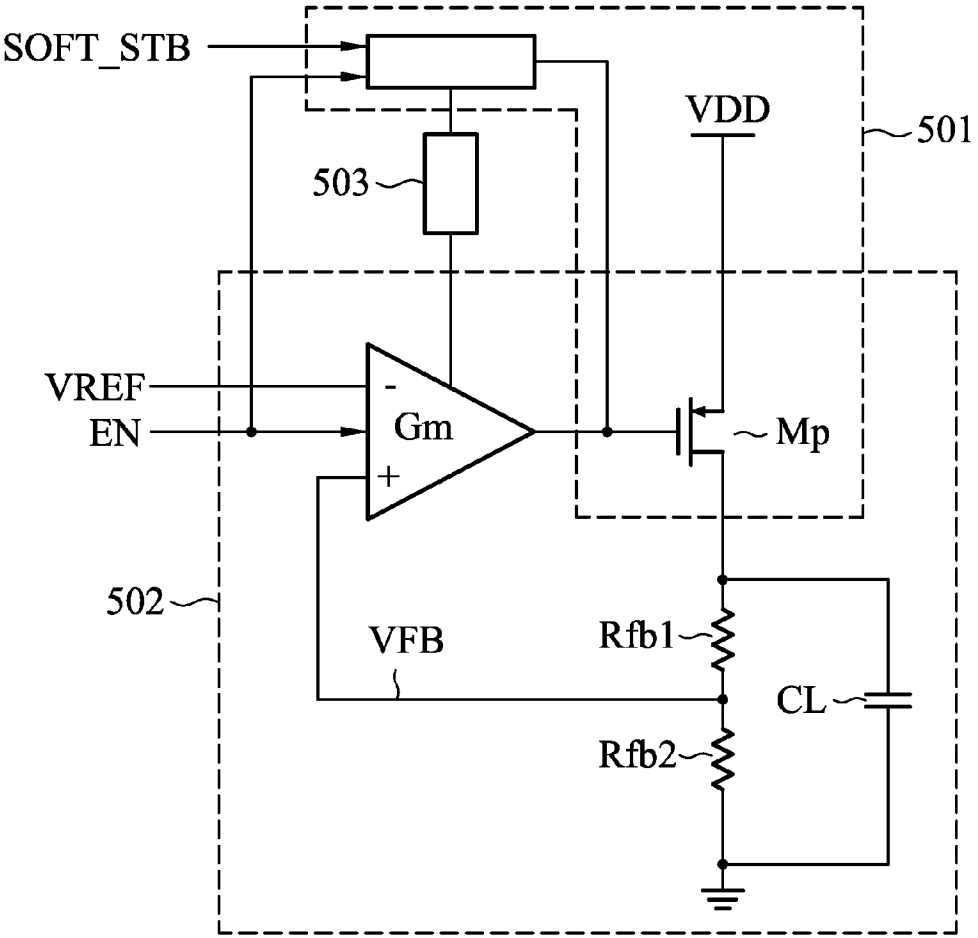
FIG. 5 shows a circuit connection of one exemplary embodiment of a low dropout linear regulator according to the invention.

An embodiment provides a low dropout linear regulator. FIG. 5 shows a circuit connection of an exemplary embodiment of a low dropout linear regulator. Referring to FIG. 5, the low dropout linear regulator comprises an over current circuit 501, an error amplifier circuit 502, and an over-current adjustor 503. During a soft-starting process of the low dropout linear regulator, the over-current adjustor 503 dynamically adjusts a threshold of an over current of the over current circuit.

Specifically, at the beginning when the low dropout linear regulator starts, a bypass capacitor is not charged, and the voltage of the bypass capacitor is equal to zero. When the low dropout linear regulator enters the soft-starting process, the over current (OC) circuit 501 begins to operate and provides a first current. The error amplifier (EA) circuit 502 is at a locked state. When the output voltage Vout reaches the starting voltage which is applied to release the locked state, the error amplifier circuit 502 begins to operate and provides a second current. At first, an over current Ioc is provided to the bypass capacitor. During the process, the over-current adjustor 503 dynamically adjusts the threshold of the over current, such that the overshoot between the output voltage Vout and a target output voltage is less. When the output voltage Vout becomes stable, the soft-starting process ends. Dynamically adjusting the threshold of the over current Ioc can be achieved in the following manner: dynamically adjusting the threshold of the over current Ioc by an auxiliary circuit (not shown) of the low dropout linear regulator according to the relationship between the target output voltage at the stable state of the low dropout linear regulator and the threshold of the over current Ioc. Accordingly, the over-current adjustor 503 can dynamically adjust the threshold of the over current Ioc, which results in the output voltage Vout entering the stable state in a short time and ensures that the overshoot between the output voltage Vout and the target output voltage is less. It should be understood that the over current comprises least one of the first current and the second current.

In one embodiment, the auxiliary circuit comprises a voltage output device (not shown). A voltage signal output by the voltage output device and the output voltage Vout of the low dropout linear regulator vary in the same direction or in two directions which are opposite to each other. The same direction or the two opposite directions mean that the variation direction of the voltage signal is the same as or opposite to that of the output voltage Vout. However, the variation amplitude of the voltage signal can be different from that of the output voltage Vout. The over-current adjustor 503 dynamically adjusts the threshold of the over current Ioc in response to the variation of the output voltage Vout.

In one embodiment, the voltage signal whose variation direction is the same as or opposite to the variation direction of the output voltage Vout can be a signal Vdy which is obtained from the error amplifier (EA) circuit. The threshold of the over current Ioc is dynamically adjusted by coupling the signal Vdy to the over-current adjustor 503.

In another embodiment, dynamically adjusting the threshold of the over current Ioc can be achieved by obtaining a signal, whose variation direction is the same as or opposite to the variation direction of the output voltage Vout, from any position on the inside of the low dropout linear regulator, disposing an adjustment device on the inside of the low dropout linear regulator, and coupling the signal to the over-current adjustor 503. There are many different embodiments for dynamically adjusting the threshold of the over current, however, the related description is omitted here.

In further another embodiment, the output voltage Vout is obtained directly from the error amplifier (EA) circuit 502 and then coupled to the over-current adjustor 503 for dynamically adjusting the threshold of the over current Ioc.

In one embodiment, when the over current (OC) circuit 501 and the error amplifier (EA) circuit 502 operate simultaneously, the over-current adjustor 503 decrease the threshold of the over current Ioc. In this embodiment, the low dropout linear regulator is regulated when the over current (OC) circuit 501 and the error amplifier (EA) circuit 502 simultaneously operate. In this case, the threshold of the over current is decreased by the low dropout linear regulator of the above embodiment, such that the overshoot between the output voltage Vout and the target output voltage becomes less to shorten the soft-starting time of the low dropout linear regulator.

In another embodiment, when the output voltage Vout approaches the target output voltage, the threshold of the over current Ioc is decreased. Specifically, at the beginning of the soft-starting process of the low dropout linear regulator, the output voltage Vout rises rapidly in response to the starting of the low dropout linear regulator. When the output voltage Vout approaches the target output voltage but has not yet reached the target output voltage, the threshold of the over current is decreased, such that the overshot between the output voltage Vout and the target output voltage is less, and the soft-starting time of the low dropout linear regulator is short.

According to the above embodiments, the low dropout linear regulator further comprises a voltage detector (not shown) which is coupled to the over-current adjustor 503. When the output voltage Vout approaches the target output voltage, the over-current adjustor 503 decreases the threshold of the over current Ioc according to a detection signal generated by the voltage detector.

In one embodiment, the over-current adjustor 503 decreases the threshold of the over current Ioc from a first current threshold to a second current threshold along a curve; or decreases the threshold of the over current Ioc from the first current threshold directly to the second current threshold. No matter which manner described above is taken to decrease the threshold of the over current Ioc, the overshot between the output voltage Vout and the target output voltage can becomes less, and the soft-starting time of the low dropout linear regulator can be shortened.

Figure 6:
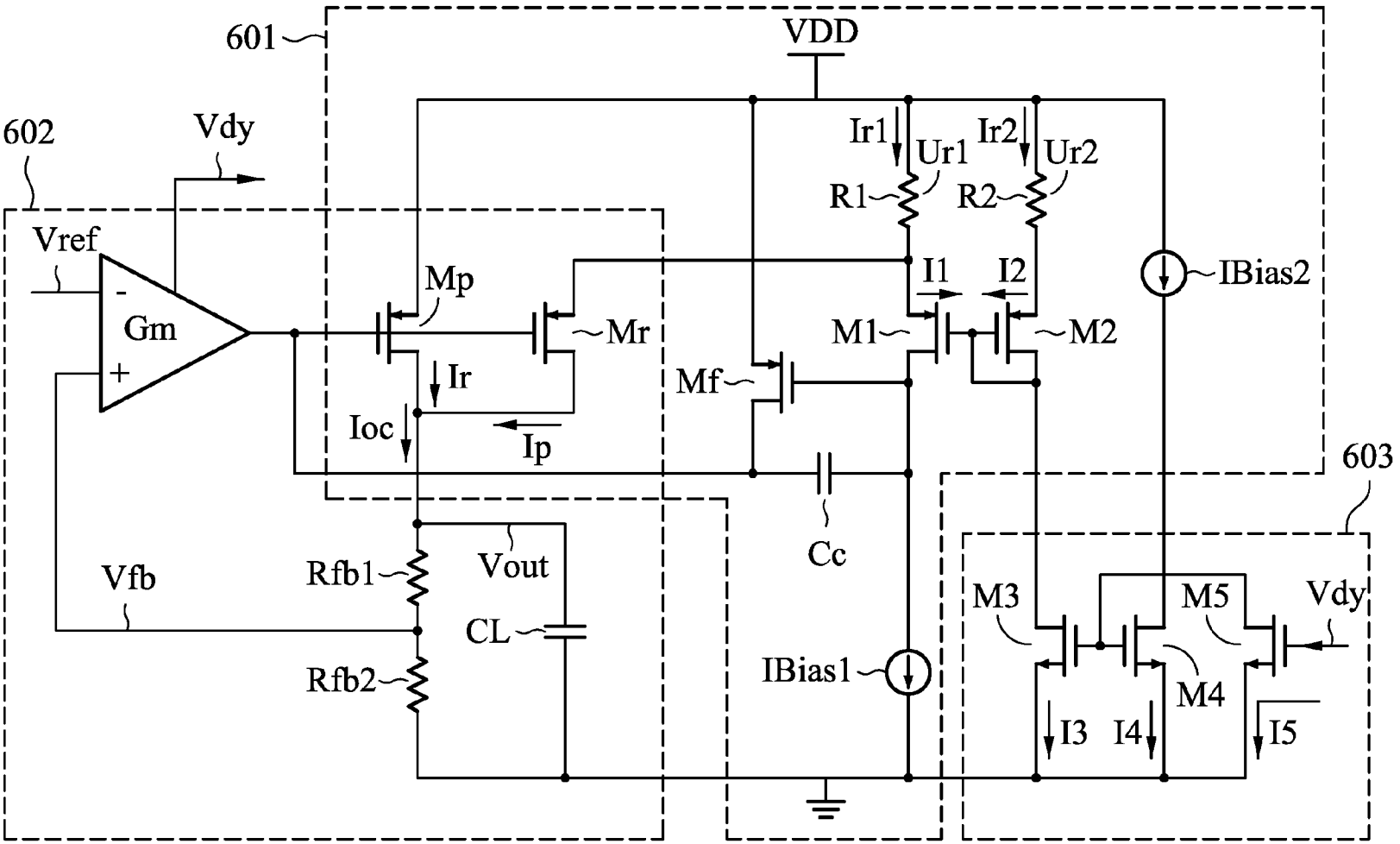
FIG. 6 shows a circuit connection of another exemplary embodiment of a low dropout linear regulator according to the invention.
Figure 7:
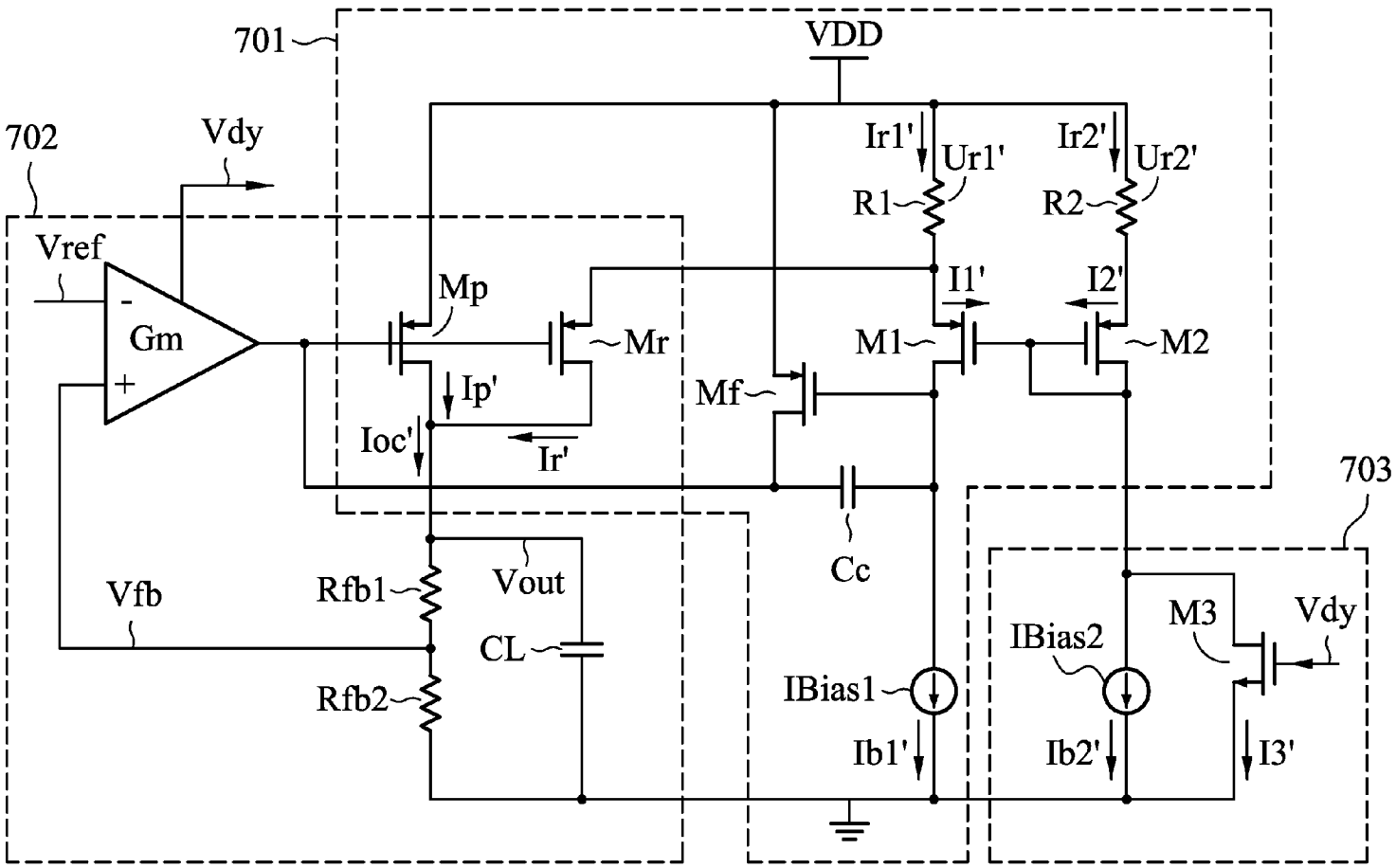
FIG. 7 shows circuit connection of further another exemplary embodiment of a low dropout linear regulator according to the invention.

FIGS. 6 and 7 show circuit connections of two exemplary embodiments of a low dropout linear regulator.

In FIG. 6, the low dropout linear regulator comprises an over current (OC) circuit 601, an error amplifier (EA) circuit 602, and an over-current adjustor 603. In the embodiment, a signal Vdy is obtained from the error amplifier (EA) circuit 602 and coupled to a gate of a transistor M5. At the beginning, a capacitor CL is not charged, and the voltage of the capacitor CL is equal to zero. When the low dropout linear regulator enters the soft-starting process, the over current (OC) circuit 601 begins to operate and charges the capacitor C1 (providing a first current). Since an output voltage Vout is less at the beginning, the error amplifier (EA) circuit 602 is at a locked state. The above charging process will be described in the following description. Since the error amplifier (EA) circuit 602 is at the locked state, the transistor M5 does not generate any current. A current of a driving current source IBias1 in the over current (OC) circuit 601 is equal to a current of a reference current source IBias2.

Transistors M3 and M4 are MOS transistors of a mirror circuit. Thus, a source current I3 of the transistor M3 is equal to a source current I4 of the transistor M4. Source currents I1 and I2 of transistors M1 and M2 of a mirror circuit are also equal. Voltages at two terminals of a resistor R1 are equal to voltages at two terminals of a resistor R2, respectively. The resistance of the resistor R2 is much larger than the resistance of the resistor R1 (R2>>R1). Thus, a current Ir1 of the resistor R1 is much larger than a current Ir2 of the resistor R2. According to current shunt theorem, a portion of the current of the resistor R1 flows to the source of the MOS transistor M1, and almost the entire remainder of the current of the resistor R1 flows to a source of a MOS transistor Mr to turn on the MOS transistor Mr. A drain current Ir of the MOS transistor Mr is proportional to a drain current Ip of a MOS transistor Mp. After the current Ip of the MOS transistor Mp copies the current Ir of the MOS transistor Mr proportionally, the drain current Ir of the MOS transistor Mr and the drain current Ip of the MOS transistor Mp jointly charge the bypass capacitor CL.

Figures 8A, 8B:
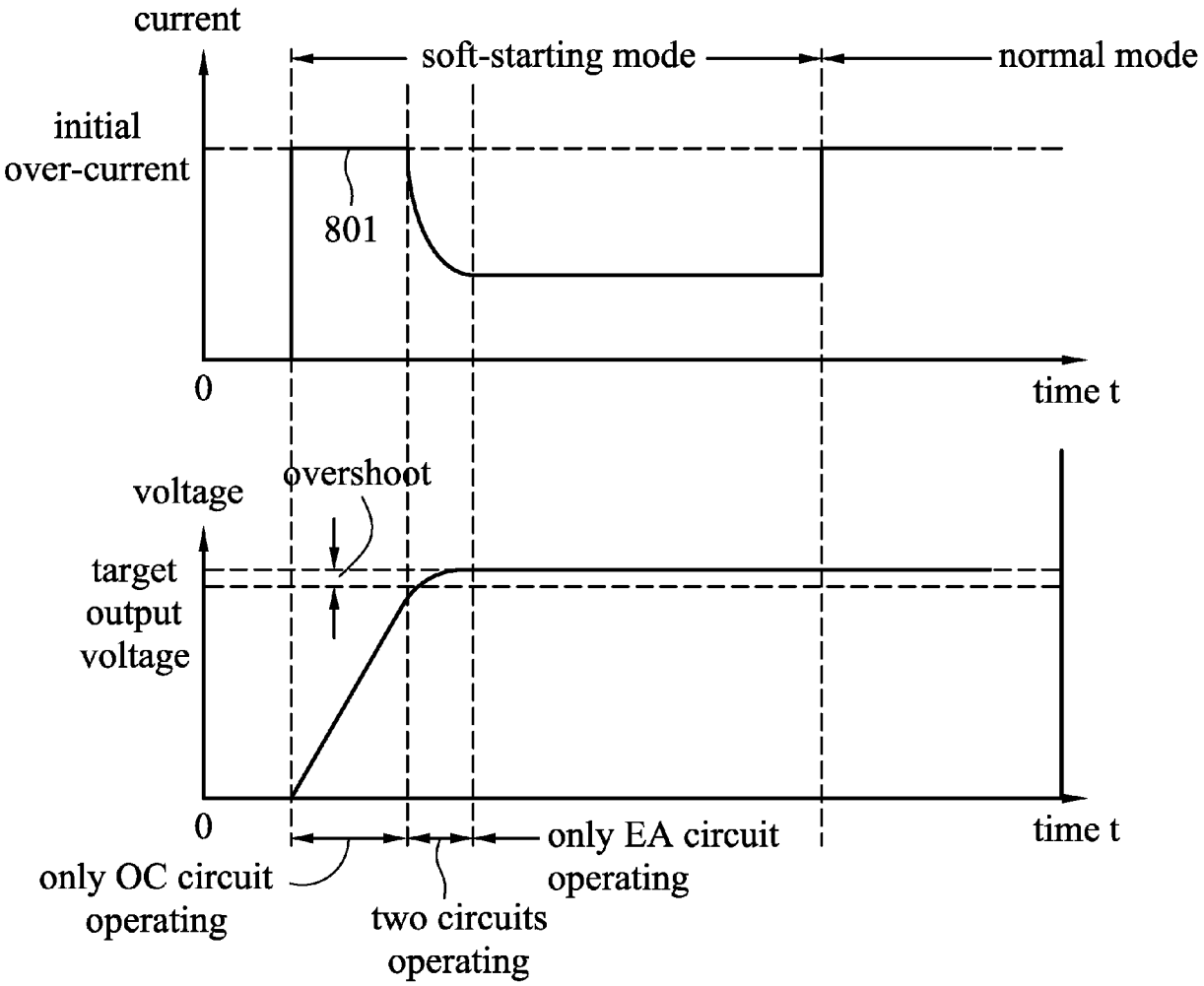
FIG. 8A shows linear variation over time of a threshold of an over current during a first soft-starting process of a low dropout linear regulator according to an embodiment of the invention.
FIG. 8B shows linear variation over time of an output voltage during the first soft-starting process of a low dropout linear regulator according to an embodiment of the invention.
Figures 9A, 9B:
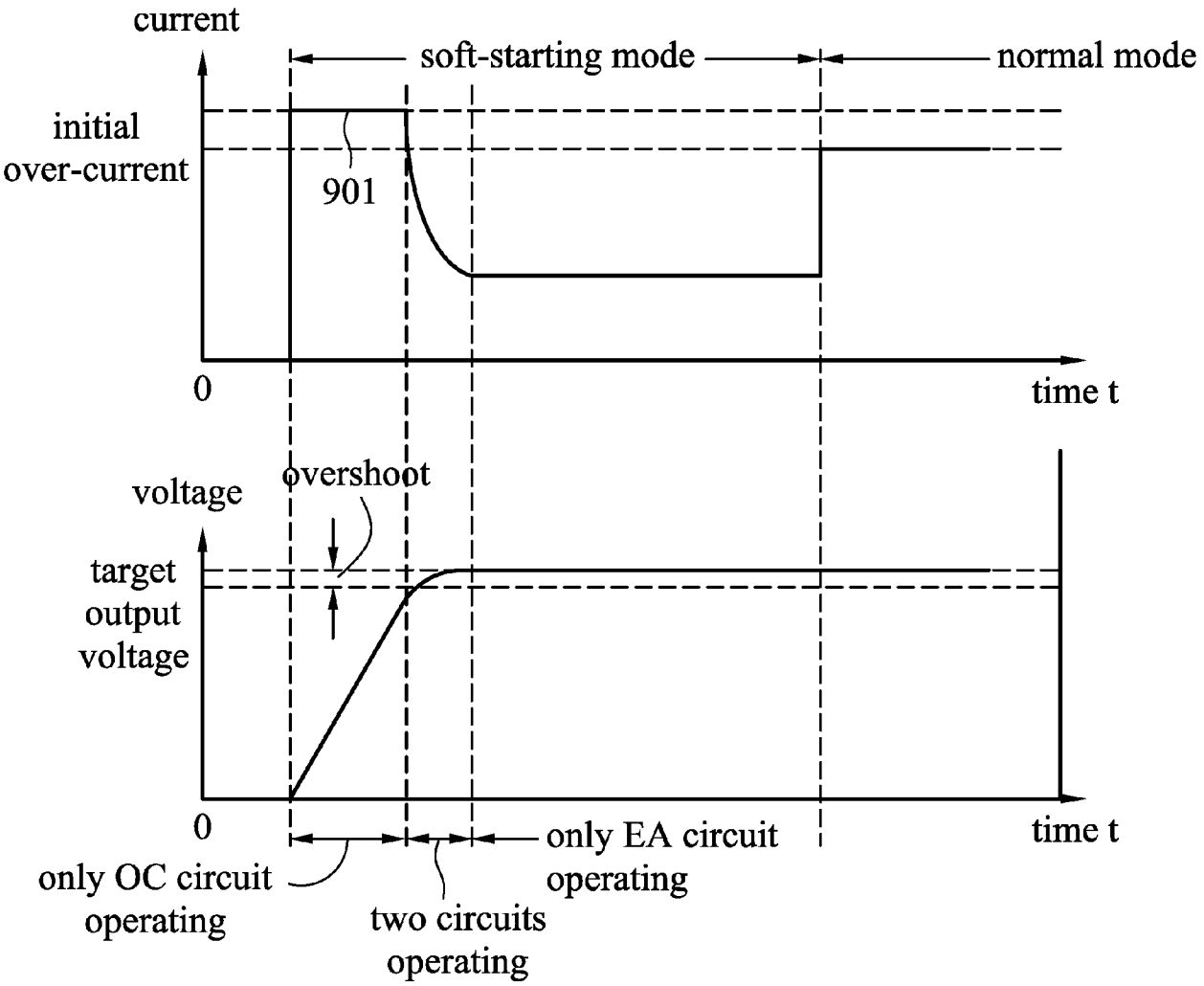
FIG. 9A shows linear variation over time of a threshold of an over current during a second soft-starting process of a low dropout linear regulator according to an embodiment of the invention.
FIG. 9B shows linear variation over time of an output voltage during the second soft-starting process of a low dropout linear regulator according to an embodiment of the invention.
Figures 10A, 10B:
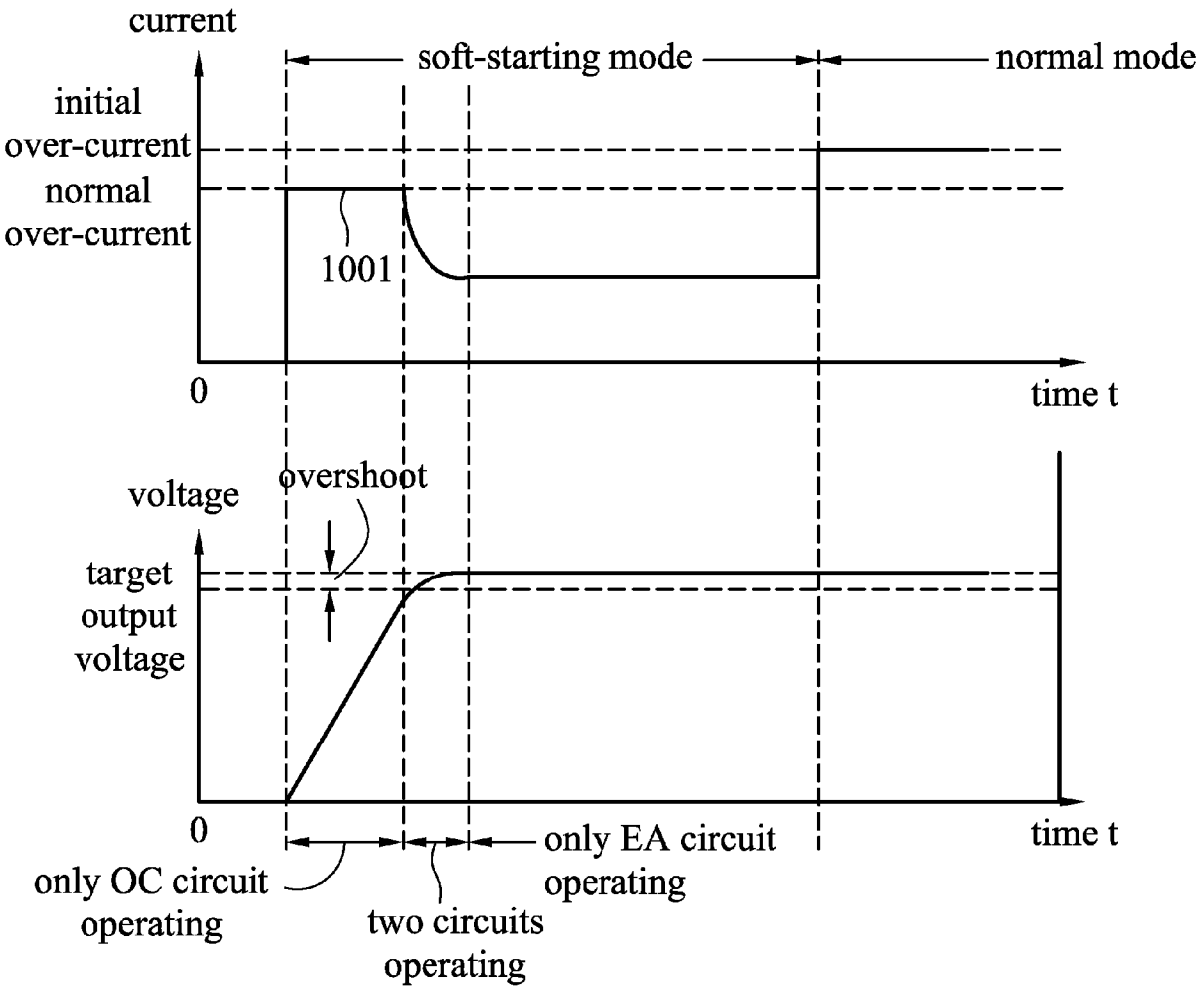
FIG. 10A shows linear variation over time of a threshold of an over current during a third soft-starting process of a low dropout linear regulator according to an embodiment of the invention.
FIG. 10B shows linear variation over time of an output voltage during the third soft-starting process of a low dropout linear regulator according to an embodiment of the invention.

As shown in FIGS. 8B, 9B, and 10B, at the beginning stage of the soft-starting process, the output voltage Vout gradually approaches the starting voltage of the error amplifier (EA) circuit 602 with the charging of the bypass capacitor CL. When the output voltage reaches the starting voltage of the error amplifier (EA) circuit 602, the error amplifier (EA) circuit 602 and the over current (OC) circuit 601 operate at the same time (the error amplifier (EA) circuit 602 providing a second current). At this time, a threshold of the over current Ioc is dynamically adjusted to be decreased to a second current threshold from a first current threshold. During the process by which the threshold of the over current Ioc is decreased, the output voltage Vout gradually becomes stable, and the overshoot between the output voltage out and the target output voltage is less. When the output voltage Vout gradually becomes stable, in the whole circuit of the low dropout linear regulator, only the error amplifier (EA) circuit 602 operates. Then, the soft-starting process ends.

In an embodiment, when only the over current (OC) circuit 601 operates, with the increasing of the over current, the output voltage Vout rises rapidly with the increasing of the over current and approaches the target output voltage. When a voltage detector detects that the output voltage Vout approaches the target output voltage, the threshold of the over current Ioc is dynamically adjusted to be decreased to the second current threshold from the first current threshold. Accordingly, during the process by which the threshold of the over current Ioc is decreased, the output voltage Vout gradually becomes stable, and the overshoot between the output voltage out and the target output voltage is less.

In the above embodiment, the decreasing of the threshold of the over current Ioc results in the overshoot between the output voltage out and the target output voltage being less. Specifically, as shown in FIG. 6, the over-current adjustor 603 is coupled to the signal Vdy whose variation direction is the same as the variation direction of the output voltage Vout. Due to the signal Vdy, a current I5 flows through a source of a MOS transistor M5 of the over-current adjustor 603 in the low dropout linear regulator. At this time, a current I4 of a source of a MOS transistor M4 is decreased, and a current I3 of a source of a MOS transistor M3 is also decreased. A voltage Ur2 and the current Ir2 of the resistor R2 are decreased, and a voltage Ur1 and the current Ir1 of the resistor R1 are also decreased, such that the drain current Ir of the MOS transistor Mr is decreased, and the drain current Ip of a MOS transistor Mp is also decreased. Finally, the threshold of the over current Ioc is decreased. Accordingly, the threshold of the over current Ioc is controlled to be decreased through the signal Vdy whose variation direction is the same as the variation direction of the output voltage Vout. The signal Vdy can be obtained from the outside of the low dropout linear regulator, from any point in the error amplifier (EA) circuit 602, or directly from the output voltage Vout if only the variation direction of the signal Vdy is the same as the variation direction of the output voltage Vout. The signal Vdy is coupled to the corresponding adjustment device. No matter where the signal Vdy is obtained, the signal Vdy can drive the over-current adjustor 603 to dynamically adjust the threshold of the over current Ioc for decreasing the threshold of the over current Ioc. The position where the signal Vdy is obtained is not limited in the present invention.

FIG. 7 shows another circuit connection of an exemplary embodiment of a low dropout linear regulator. In FIG. 7, the low dropout linear regulator comprises an over current (OC) circuit 701, an error amplifier (EA) circuit 702, and an over-current adjustor 703. In the embodiment, a signal Vdy, whose variation direction is opposite to the variation direction of the output voltage Vout, is obtained from the error amplifier (EA) circuit 702 and coupled to a gate of a transistor M3. At the beginning, a capacitor CL is not charged, and the voltage of the capacitor CL is equal to zero. When the soft-starting process starts, the over current (OC) circuit 701 operates and provides a first current. At this time, the error amplifier (EA) circuit 702 is at a locked state. With the increasing of the output Vout, when the error amplifier (EA) circuit 702 and the over current (OC) circuit 701 operate at the same time (the error amplifier (EA) circuit 702 providing a second current), a threshold of the over current Ioc is dynamically adjusted by the over-current adjustor 703 to be decreased to a second current threshold from a first current threshold. In an embodiment as shown in FIG. 7, at the beginning, the sum of a current I3' of a transistor M3 and a current Ib2' of a driving current source IBias2 is equal to a current Ib1' of a driving current source IBias1. A current IF of a transistor M1 is equal to a current I2' of a transistor M2. Voltages at two terminals of a resistor R1 are equal to voltages at two terminals of a resistor R2, respectively. The resistance of the resistor R2 is much larger than the resistance of the resistor R1 (R2>>R1). Thus, a current Ir1' of the resistor R1 is much larger than a current Ir2' of the resistor R2. According to current shunt theorem, a portion of the current of the resistor R1 flows to a source of a MOS transistor Mr to turn on the MOS transistor Mr. A drain current Ir' of the MOS transistor Mr is proportional to a drain current Ip' of a MOS transistor Mp. After the current Ip' of the MOS transistor Mp is obtained by reproducing the current Ir' of the MOS transistor Mr proportionally, the drain current Ir' of the MOS transistor Mr and the drain current' Ip of the MOS transistor Mp jointly charge the bypass capacitor CL. With the charging of the bypass capacitor CL. the output voltage Vout gradually approaches to the starting voltage of the error amplifier (EA) circuit 702 When the output voltage reaches the starting voltage of the error amplifier (EA) circuit 702, the error amplifier (EA) circuit 702 and the over current (OC) circuit 701 operate at the same time. At this time, the signal Vdy is applied to decrease the current I3' of the transistor M3 in the low dropout linear regulator. Since the current Ib2' of the driving current source IBias2 does not change, the current (gate source) I2' of the transistor M2 is decreased, and the current (gate source) I1' of the transistor M1 is also decreased. Moreover, a voltage Ur1' and the current Ir1' of the resistor R1 and a voltage Cr2' and the current Ir2' of the resistor R2 are decreased, such that the drain current Ir' of the MOS transistor Mr and the drain current Ip' of the MOS transistor Mp are also decreased. Finally, the adjustment of the threshold of the over current Ioc is achieved. Accordingly, the threshold of the over current Ioc is dynamically adjusted to be decreased through the variation of the signal Vdy. The signal Vdy can be obtained from the outside of the low dropout linear regulator, from any point in the error amplifier (EA) circuit 702, or directly from the output voltage Vout if only the variation direction of the signal Vdy is opposite to the variation direction of the output voltage Vout. The signal Vdy is coupled to the corresponding adjustment device. No matter where the signal Vdy is obtained, the signal Vdy can drive the over-current adjustor 703 to dynamically adjust the threshold of the over current Ioc for decreasing the threshold of the over current Ioc. The position where the signal Vdy is obtained is not limited in the present invention.

Except the embodiments in FIGS. 6 and 7, in some embodiments, the obtained signal Vdy can be coupled to a corresponding electronic element to control variation of the currents of the transistors M1 and M2, which results in the decreasing of the over current Ioc. Thus, the output voltage Vout can become stable in a short time, and the overshoot between the output voltage Vout and the target output voltage is less. For example, the signal Vd is provided to the current source Ibias1 through the corresponding electronic element, thereby controlling the variation of the currents of the MOS transistors M1 and M2. The description related to the specific circuit connection is omitted here.

Figure 11:
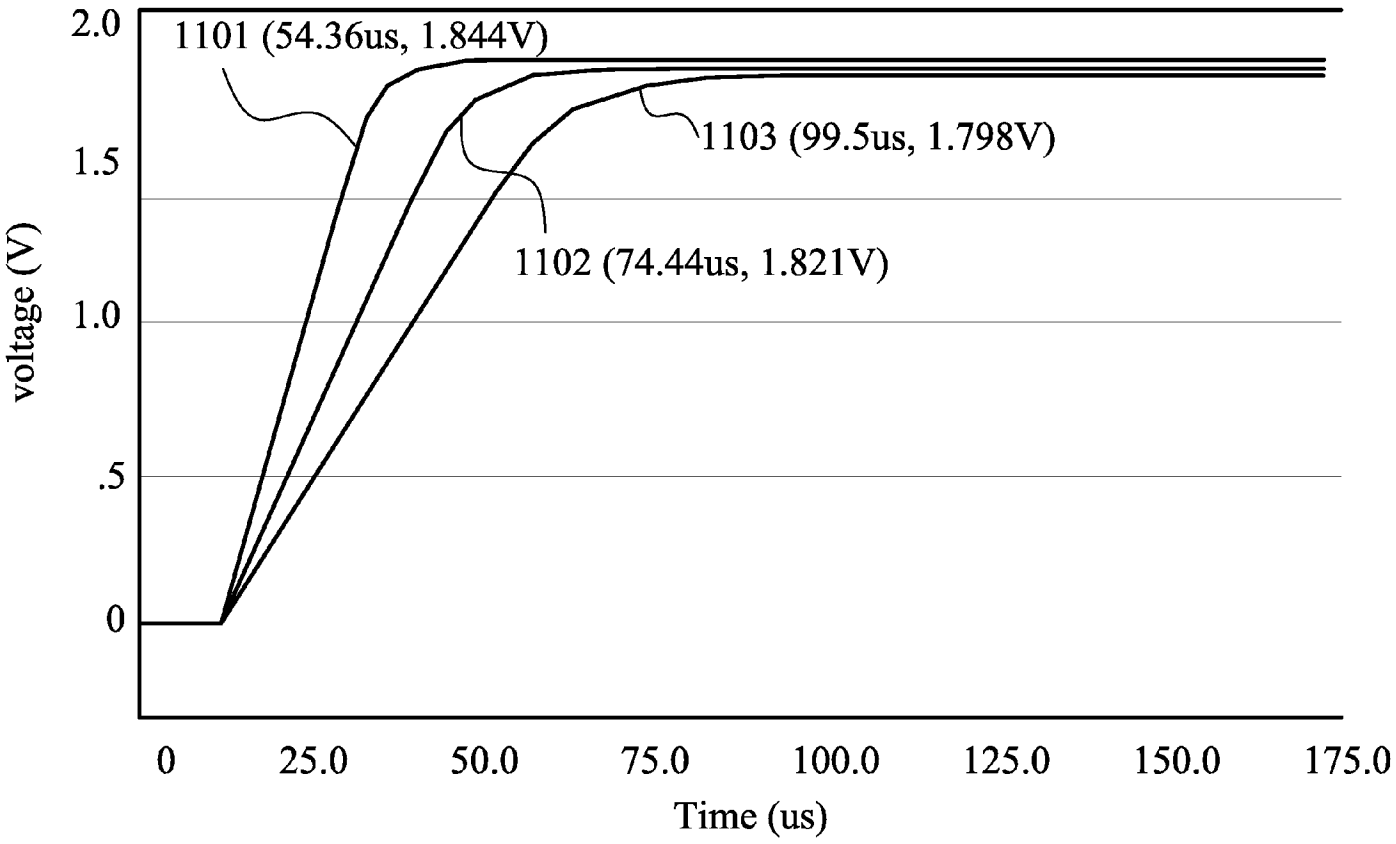
FIG. 11 shows simulation diagram illustrating linear variation over time of an output voltage during the three soft-starting processes of a low dropout linear regulator according to embodiments of the invention.

As shown in FIGS. 8A, 9A, and 10A, the decreasing of the threshold of the over current Ioc can diminish the overshoot of the output voltage Vout to the target output voltage. There are three embodiments for decreasing the threshold of the over current Ioc. In FIG. 8A, during the soft-starting of the low dropout linear regulator, when the threshold of the initial over current is equal to the threshold of the normal over current required in the stable state, the threshold of the over current Ioc is dynamically adjusted to be decreased to the second current threshold from the first current threshold along a curve 801. FIG. 9A shows the variation over time of the threshold of the over current during a second soft-starting process. In FIG. 9A, when the threshold of the initial over current is larger than the threshold of the normal over current required in the stable state, the threshold of the over current Ioc is dynamically adjusted to be decreased to the second current threshold from the first current threshold along a curve 901 which is steeper than the curve 801 of the previous embodiment. FIG. 10A shows the variation over time of the threshold of the over current during a third soft-starting process. In FIG. 10A, when the threshold of the initial over current is smaller than the threshold of the normal over current required in the stable state, the threshold of the over current Ioc is decreased to the second current threshold from the first current threshold along a curve 1001 which is more gradual than the curves 801 and 901 of the previous embodiments. In the above three embodiments, although the threshold of the over current Ioc is variable, the same method is applied to dynamically adjust the threshold of the over current to an appropriate position along a curve, thereby achieving the purpose of the decreasing of the threshold of the over current Ioc. Thus, the circuit can enter a stable state in a short time, and it is sure that the overshoot of the output voltage Vout is less. FIG. 11 shows the simulation diagram illustrating variation over time of the output voltage Vout during the three soft-starting processes of the low dropout linear regulator. A curve 1101 represents the simulated curve of the variation over time of the output voltage Vout when the threshold of the initial over current is larger than the threshold of the normal over current required in the stable state. A curve 1102 represents the simulated curve of the variation over time of the output voltage Vout when the threshold of the initial over current is equal to the threshold of the normal over current required in the stable state. A curve 1103 represents the simulate curve of the variation over time of the output voltage Vout when the threshold of the initial over current is smaller than the threshold of the normal over current required in the stable state. According to the curve 1101, among the three curves 1101, 1102, and 1103, the starting time during the soft-starting process is the shortest, but the overshoot is greatest. According to the curve 1102, the medium one, the starting time during the soft-starting process is the medium one, and the overshoot is the medium one. According to the curve 1103, among the three curves 1101, 1102, and 1103, the starting time during the soft-starting process is the longest, but the overshoot is smallest. According to the requirements of the starting operation of the circuit, one of the above three soft-starting processes is applied, such that the starting of the circuit can have the best mode.

When the output voltage Vout approaches a stable state with the decreasing of the threshold of the over current, the over current (OC) operation stops operating, and only the error amplifier (EA) circuit operates normally. At this time, the decreased over current then rises rapidly to the threshold of the normal over current, however, the output voltage Vout is not varied with the variation of the over current. The above situation represents the ending of the soft-starting process, and the low dropout linear regulator enters the normal operation mode.

In an embodiment, the decreasing of the threshold of the over current comprise: decreasing the threshold of the over current to the second current threshold from the first current threshold along a curve; or decreasing the threshold of the over current directly to the second current threshold from the first current threshold.

An embodiment of an electronic device is provided. The electronic device comprises the low dropout linear regulator in any one of the above embodiments.

An embodiment of a chip is also provided. The chip comprises the low dropout linear regulator in any one of the above embodiments.

As described above, the embodiments of the present invention provide a low dropout linear regulator, a starting method of the low dropout linear regulator, an electronic device, and a chip, which accomplish a soft-starting process with small overshoot in a starting time, effectively protecting the circuit, and enhancing usage quality and life.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A starting method for a low dropout linear regulator which comprises an error amplifier circuit, an over current circuit and an over-current adjustor, comprising:

beginning a soft-starting process of the low dropout linear regulator and turning on a first transistor and a second transistor to provide a over current to raise an output voltage of the low dropout linear regulator;

maintaining the 'turn on' state of the first transistor and the second transistor and decreasing the over current according to a signal obtained from the error amplifier circuit after the output voltage of the low dropout linear regulator reaches a starting voltage of the error amplifier circuit;

wherein the error amplifier circuit begins to operate when the output voltage of the low dropout linear regulator reaches the starting voltage of the error amplifier circuit.

2. The starting method as claimed in claim 1, wherein the signal obtained from the error amplifier is a signal whose variation direction is the same as a variation direction of the output voltage or whose variation direction is opposite to the variation direction of the output voltage.

3. The starting method as claimed in claim 1, wherein the signal obtained from the error amplifier is the output voltage of the error amplifier circuit.

4. The starting method as claimed in claim 1, wherein the step of decreasing the over current according to a signal obtained from the error amplifier circuit is performed when the over current circuit and the error amplifier circuit operate at the same time.

5. The starting method as claimed in claim 1, wherein the step of decreasing the over current according to a signal obtained from the error amplifier circuit is performed when the output voltage reaches a target output voltage.

6. The starting method as claimed in one of claim 1, wherein the step of decreasing the over current according to a signal obtained from the error amplifier circuit comprises:

decreasing the over current from a first current threshold to a second current threshold along a curve according to a signal obtained from the error amplifier circuit; or decreasing the over current directly from the first current threshold to the second current threshold according to a signal obtained from the error amplifier circuit.

7. A low dropout linear regulator, comprising:

an over current circuit, beginning a soft-starting process of the low dropout linear regulator, and turning on a first transistor and a second transistor to provide a over current to raise an output voltage of the low dropout linear regulator when begins;

an error amplifier circuit, beginning to operate when an output voltage of the low dropout linear regulator reaches a starting voltage of the error amplifier circuit; and an over-current adjustor, maintaining the 'turn on' state of the first transistor and the second transistor and decreasing the over current according to a signal obtained from the error amplifier circuit after the output voltage of the low dropout linear regulator reaches a starting voltage of the error amplifier circuit.

8. The low dropout linear regulator as claimed in claim 7, wherein over-current adjustor decreases the over current according to a signal, whose variation direction is the same as a variation direction of the output voltage, obtained from the error amplifier circuit; or the over-current adjustor decreases the over current according to a signal, whose variation direction is opposite to the variation direction of the output voltage, obtained from the error amplifier circuit.

9. The low dropout linear regulator as claimed in claim 7, wherein the over-current adjustor decreases the over current according to the output voltage obtained from the error amplifier circuit.

10. The low dropout linear regulator as claimed in claim 7, wherein the over-current adjustor decreases the over current according to the signal obtained from the error amplifier circuit when the over current circuit and the error amplifier circuit operate at the same time.

11. The low dropout linear regulator as claimed in claim 7, further comprising:

a voltage detector, coupled to the over-current adjustor, generating a detection signal when the output voltage approaches a target output voltage, wherein the over-current adjustor decreases the over current according to a signal obtained from the error amplifier circuit when the detection signal indicates that the output voltage reaches the target output voltage.

12. The low dropout linear regulator as claimed in one of claim 7, wherein according to a signal obtained from the error amplifier circuit, the over-current adjustor decreases the over current from a first current threshold to a second current threshold along a curve; or according to a signal obtained from the error amplifier circuit, the over-current adjustor decreases the over current directly from the first current threshold to the second current threshold.

13. An electronic device, comprising:

a low dropout linear regulator, wherein the low dropout linear regulator comprises:

an over current circuit, turning on a first transistor and a second transistor to provide a over current to raise an output voltage of the low dropout linear regulator when a soft-starting process of the low dropout linear regulator begins;

an error amplifier circuit, beginning to operate when an output voltage of the low dropout linear regulator reaches a starting voltage of the error amplifier circuit; and an over-current adjustor, maintaining the 'turn on' state of the first transistor and the second transistor and decreasing the over current according to a signal obtained from the error amplifier circuit after the output voltage of the low dropout linear regulator reaches a starting voltage of the error amplifier circuit.

14. An chip comprising:

a low dropout linear regulator, wherein the low dropout linear regulator comprise:

an over current circuit, turning on a first transistor and a second transistor to provide a over current to raise an output voltage of the low dropout linear regulator when a soft-starting process of the low dropout linear regulator begins;

an error amplifier circuit, beginning to operate when an output voltage of the low dropout linear regulator reaches a starting voltage of the error amplifier circuit; and an over-current adjustor, maintaining the 'turn on' state of the first transistor and the second transistor and decreasing the over current according to a signal obtained from the error amplifier circuit after the output voltage of the low dropout linear regulator reaches a starting voltage of the error amplifier circuit.

* * * * *